US009402135B1

(12) United States Patent
Norris et al.

(10) Patent No.: US 9,402,135 B1
(45) Date of Patent: Jul. 26, 2016

(54) MAGNETOSTRICTIVE PARAMETRIC TRANSDUCER

(71) Applicant: Turtle Beach Corporation, Poway, CA (US)

(72) Inventors: Elwood Grant Norris, Poway, CA (US); Brian Alan Kappus, San Diego, CA (US)

(73) Assignee: Turtle Beach Corporation, San Diego, CA (US)

( * ) Notice: Subject to any disclaimer, the term of this patent is extended or adjusted under 35 U.S.C. 154(b) by 0 days.

(21) Appl. No.: 14/510,908

(22) Filed: Oct. 9, 2014

Related U.S. Application Data

(60) Provisional application No. 61/889,599, filed on Oct. 11, 2013.

(51) Int. Cl.
*H04R 15/00* (2006.01)

(52) U.S. Cl.
CPC ..... *H04R 15/00* (2013.01); *H04R 2217/00* (2013.01); *H04R 2217/01* (2013.01)

(58) Field of Classification Search
USPC ..... 381/190
See application file for complete search history.

(56) References Cited

U.S. PATENT DOCUMENTS

| | | | | |
|---|---|---|---|---|
| 4,191,863 | A * | 3/1980 | Matsuda | H04R 9/063 381/182 |
| 4,768,615 | A * | 9/1988 | Steinebrunner | G10K 13/00 181/157 |
| 5,355,714 | A * | 10/1994 | Suzuki | B60C 23/0408 336/30 |
| 2004/0264707 | A1* | 12/2004 | Yang | G10K 15/02 381/77 |
| 2008/0044042 | A1* | 2/2008 | Liu | H04R 9/00 381/150 |
| 2011/0311092 | A1* | 12/2011 | Kosuda | H04R 7/06 381/398 |
| 2013/0251176 | A1* | 9/2013 | Goto | H04R 1/00 381/152 |

* cited by examiner

*Primary Examiner* — Amir Etesam
(74) *Attorney, Agent, or Firm* — Sheppard Mullin Richter & Hampton LLP

(57) ABSTRACT

An ultrasonic audio magnetostrictive emitter configured to emit an audio modulated ultrasonic beam. The magnetostrictive emitter may include an emissive surface, a back plate and at least one magnetostrictive actuator positioned between the emissive surface and the back plate. Ultrasonic audio systems incorporating a magnetostrictive emitter may further be provided.

13 Claims, 6 Drawing Sheets

MAGNETOSTRICTIVE PARAMETRIC TRANSDUCER

CROSS-REFERENCE TO RELATED APPLICATIONS

This application claims the benefit of Provisional Patent Application Ser. No. 61/889,599 filed on Oct. 11, 2013, which is hereby incorporated herein by reference in its entirety.

TECHNICAL FIELD

The present disclosure relates generally to parametric emitters for a variety of applications. More particularly, some embodiments relate to a magnetostrictive emitter.

BACKGROUND OF THE INVENTION

Non-linear transduction results from the introduction of sufficiently intense, audio-modulated ultrasonic signals into an air column. Self-demodulation, or down-conversion, occurs along the air column resulting in the production of an audible acoustic signal. This process occurs because of the known physical principle that when two sound waves with different frequencies are radiated simultaneously in the same medium, a modulated waveform including the sum and difference of the two frequencies is produced by the non-linear (parametric) interaction of the two sound waves. When the two original sound waves are ultrasonic waves and the difference between them is selected to be an audio frequency, an audible sound can be generated by the parametric interaction.

Parametric audio reproduction systems produce sound through the heterodyning of two acoustic signals in a non-linear process that occurs in a medium such as air. The acoustic signals are typically in the ultrasound frequency range. The non-linearity of the medium results in acoustic signals produced by the medium that are the sum and difference of the acoustic signals. Thus, two ultrasound signals that are separated in frequency can result in a difference tone that is within the 60 Hz to 20,000 Hz range of human hearing.

SUMMARY

Various embodiments of the technology disclosed herein can be configured to provide a magnetostrictive emitter configured to emit an ultrasonic signal. In some embodiments, the ultrasonic signal emitted by the magnetostrictive emitter can be an audio modulated ultrasonic signal to deliver audio content to a listener. In various embodiments, the magnetostrictive emitter can be configured to include an emissive surface, a back plate, and one or more magnetostrictive actuators that can be configured to induce vibrations on the emissive surface in response to electrical signals applied to the one or more actuators. Particularly, in some applications, an electrical signal representing audio content (e.g., music, voice, or other audio) modulated onto an ultrasonic carrier can be used to drive the magnetostrictive actuator. The electrical signal is provided to a a coil or winding of wire or wires in each actuator. The signal induces a magnetic field proximal to the coil which causes a ferromagnetic core of the magnetostrictive actuator to change dimensions. These changes in dimension impart a time varying force on the emissive surface, causing the emissive surface to vibrate. This vibration of the emissive surface results in a change in pressure in the air surrounding the emissive surface launching the ultrasonic signal into the air (or other medium surrounding the emitter).

Because changes in the magnetic field in the actuator correspond to changes current or voltage in the electrical signal, the magnetostrictive actuator changes dimensions in correspondence with the electrical signal. In embodiments where the electrical signal is an audio-modulated ultrasonic signal the magnetostrictive actuator changes shape in correspondence with that electrical signal. Accordingly, a pressure wave launched into the air by the emissive surface in response to vibrations induced by the magnetostrictive actuator is an audio modulated ultrasonic wave that corresponds to or represents the audio content modulated onto the ultrasonic carrier. In this manner, a magnetostrictive emitter can be used to emit ultrasonic audio.

Magnetostrictive materials can be used to invert magnetic energy (e.g. induced as a result of the electrical signal) into kinetic energy. This kinetic energy is manifested as a change in dimension (e.g., length) of the actuator core as a result of the magnetization. Examples of magnetostrictive materials are discussed further below. In various embodiments, the magnetostrictive actuator includes a ferromagnetic core, a magnetizing coil and may also include a magnetic enclosure. Certain embodiments may also include a contact element that can be disposed between the core and the emissive surface. For ease of description, the contact element may be referred to herein as a cap or a horn. Further embodiments may also include a base on which the magnetostrictive actuator can be mounted to the back plate.

The contact element may be configured to provide the point or points of contact by the actuator to the emissive surface. As described in various examples, the Can be configured with a number of different geometries including, cylindrical, rectangular, and conical. In some embodiments, the end of the contact element interfacing with the emissive surface has a relatively small surface area so that, while it induces vibrations into the emissive surface, it does not otherwise interfere with vibration of the emissive surface. In some embodiments, the contact element may provide support for the emissive surface. In other embodiments, the emissive surface can be completely supported on the back plate by other means (e.g. stanchions, mounting brackets, mounting supports, and so on). In further embodiments, the weight bias can be applied across the emissive surface and the back plate to maintain pressure of the emissive surface on the actuators.

As further described herein, in some embodiments the actuators are configured to induce vibration in the emissive surface as a result of direct contact of the actuators with the emissive surface. In other embodiments, direct physical contact is not utilized and vibrations may be induced in the emissive surface by the actuators as a result of, for example, magnetic fields between the actuator(s) and emissive surface, or fluid pressure (e.g. air pressure) induced into the fluid medium (e.g., error) between the actuator(s) and the emissive surface.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the accompanying figures. The drawings are provided for purposes of illustration only and merely depict typical or example embodiments of the invention. These drawings are provided to facilitate the reader's understanding of the systems and methods described herein, and shall not be considered limiting of the breadth, scope, or applicability of the claimed invention.

Some of the figures included herein illustrate various embodiments of the invention from different viewing angles. Although the accompanying descriptive text may refer to elements depicted therein as being on the "top," "bottom" or "side" of an apparatus, such references are merely descriptive and do not imply or require that the invention be implemented or used in a particular spatial orientation unless explicitly stated otherwise. Likewise, references to "up," "down," "left," and "right" do not imply or require a particular spatial orientation.

The figures are not intended to be exhaustive or to limit the invention to the precise form disclosed. It should be understood that the invention can be practiced with modification and alteration, and that the invention be limited only by the claims and the equivalents thereof.

DESCRIPTION

Embodiments of the systems and methods described herein provide an ultrasonic emitter including one or more magnetostrictive actuators used to induce vibrations in an emissive surface of the emitter at ultrasonic frequencies. In various embodiments, the magnetostrictive emitter can be configured to include an emissive surface, a back plate, and one or more magnetostrictive actuators that can be configured to induce vibrations on the emissive surface in response to electrical signals applied to the one or more actuators. The emissive surface can be implemented, for example, with a film (e.g., Mylar®, Kapton®, or other like film) a thin plate (e.g., metal, glass, plastic, and so on), or other rigid or material capable of responding to stimulation provided by the magnetostrictive actuator or actuators. Preferably, films such as Mylar, Kapton and other like films are tensioned so that they can vibrate in response to varying pressure applied by the actuator(s). Where a plate is used for the emissive surface, the plate is preferably rigid or semi-rigid such that vibrations can be set up in the plate in response to varying pressure applied by the actuator(s).

Before describing the magnetostrictive emitter in detail, it is useful to describe a few example ultrasonic audio systems with which the emitter may be used. Description of these audio systems is provided by way of example only and is not intended to limit the applicability of a magnetostrictive emitter. Indeed, after reading these descriptions, one of ordinary skill in the art will understand how a magnetostrictive emitter can be applied in a number of different applications including ultrasonic audio systems as well as other ultrasonic devices.

Figure 1:
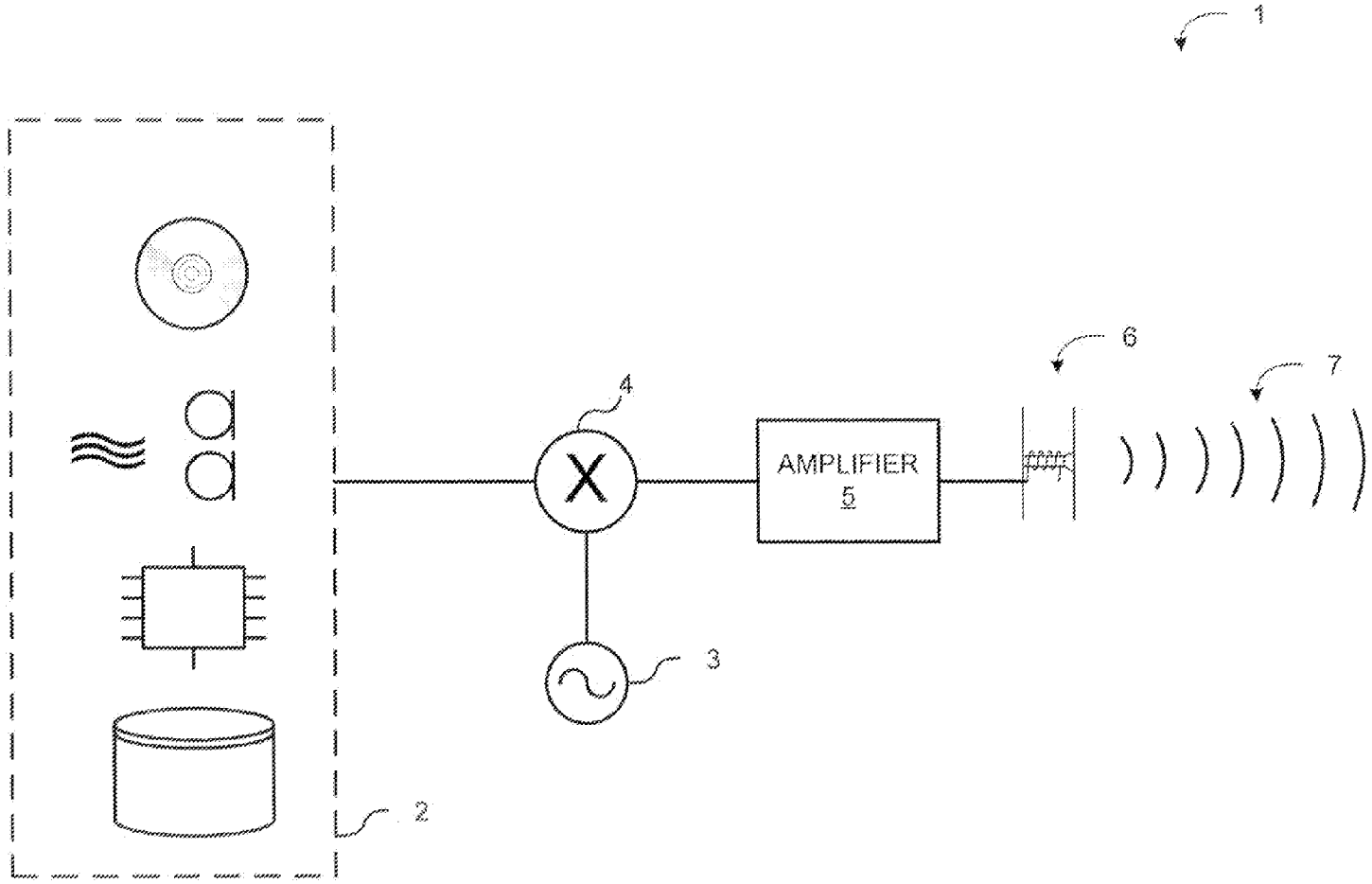
FIG. 1 is a diagram illustrating an ultrasonic sound system suitable for use with the emitter technology described herein.

FIG. 1 is a diagram illustrating an ultrasonic sound system suitable for use in conjunction with magnetostrictive emitters described herein. In this exemplary ultrasonic system 1, audio content from an audio source 2, such as, for example, a microphone, memory, a data storage device, streaming media source, MP3, CD, DVD, set-top-box, or other audio source is received. The audio content may be decoded and converted from digital to analog form, depending on the source. The audio content received by the audio system 1 is modulated onto an ultrasonic carrier of frequency f1, using a modulator. The modulator typically includes a local oscillator 3 to generate the ultrasonic carrier signal, and modulator 4 to modulate the audio signal on the carrier signal. The resultant signal is a double- or single-sideband signal with a carrier at frequency f1 and one or more side lobes. In some embodiments, the signal is a parametric ultrasonic wave. In most cases, the modulation scheme used is amplitude modulation, or AM, although other modulation schemes can be used as well. Amplitude modulation can be achieved by multiplying the ultrasonic carrier by the information-carrying signal, which in this case is the audio signal. The spectrum of the modulated signal can have two sidebands, an upper and a lower side band, which are symmetric with respect to the carrier frequency, and the carrier itself.

The modulated ultrasonic signal is provided to the transducer 6, which launches the ultrasonic signal into the air creating ultrasonic wave 7. Transducer 6 can implemented using a magnetostrictive emitter. When emitted by the transducer at a sufficiently high sound pressure level, due to nonlinear behavior of the air through which it is 'played' or transmitted, the carrier in the signal mixes with the sideband(s) to demodulate the signal and reproduce the audio content. This is sometimes referred to as self-demodulation. Thus, even for single-sideband implementations, the carrier is included with the launched signal so that self-demodulation can take place.

Although the system illustrated in FIG. 1 uses a single transducer 6 to launch a single channel of audio content, one of ordinary skill in the art after reading this description will understand how multiple mixers, amplifiers and transducers can be used to transmit multiple channels of audio using ultrasonic carriers. The ultrasonic transducers can be mounted in any desired location depending on the application.

Figure 2:
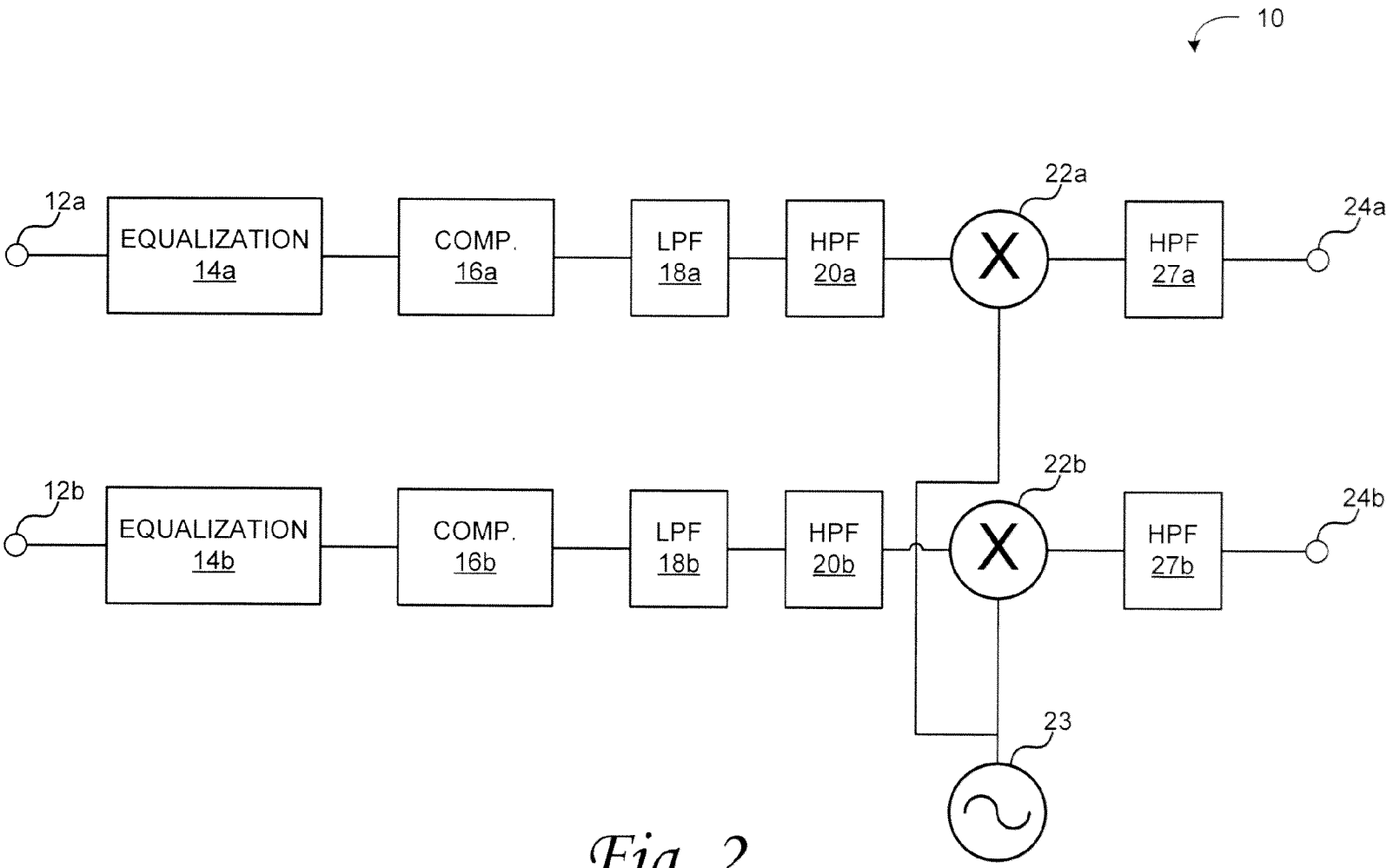
FIG. 2 is a diagram illustrating another example of a signal processing system that is suitable for use with the emitter technology described herein.

One example of an audio processing system 10 that is suitable for use with the technology described herein is illustrated schematically in FIG. 2. In this embodiment, various processing circuits or components are illustrated in the order (relative to the processing path of the signal) in which they are arranged according to one implementation. It is to be understood that the components of the processing circuit can vary, as can the order in which the input signal is processed by each circuit or component. Also, depending upon the embodiment, the audio processing system 10 can include more or fewer components or circuits than those shown.

Also, the example shown in FIG. 1 is optimized for use in processing two input and output channels (e.g., a "stereo" signal), with various components or circuits including substantially matching components for each channel of the signal. It will be understood by one of ordinary skill in the art after reading this description that the audio system can be implemented using a single channel (e.g., a "monaural" or "mono" signal), two channels (as illustrated in FIG. 2), or a greater number of channels.

Referring now to FIG. 2, the example signal processing system 10 can include audio inputs that can correspond to left 12*a* and right 12*b* channels of an audio input signal. Equalizing networks 14*a*, 14*b* can be included to provide equalization of the signal. The equalization networks can, for example, boost or suppress predetermined frequencies or frequency ranges to increase the benefit provided naturally by the emitter/inductor combination of the parametric emitter assembly.

After the audio signals are equalized compressor circuits 16*a*, 16*b* can be included to compress the dynamic range of the incoming signal, effectively raising the amplitude of certain portions of the incoming signals and lowering the amplitude of certain other portions of the incoming signals. More particularly, compressor circuits 16*a*, 16*b* can be included to narrow the range of audio amplitudes. In one aspect, the compressors lessen the peak-to-peak amplitude of the input signals by a ratio of not less than about 2:1. Adjusting the input signals to a narrower range of amplitude can be done to minimize distortion, which is characteristic of the limited dynamic range of this class of modulation systems. In other embodiments, the equalizing networks 14*a*, 14*b* can be provided after compressors 16*a*, 16*b*, to equalize the signals after compression.

Low pass filter circuits 18*a*, 18*b* can be included to provide a cutoff of high portions of the signal, and high pass filter circuits 20*a*, 20*b* providing a cutoff of low portions of the audio signals. In one exemplary embodiment, low pass filters 18*a*, 18*b* are used to cut signals higher than about 15-20 kHz, and high pass filters 20*a*, 20*b* are used to cut signals lower than about 20-200 Hz.

Figure 6:
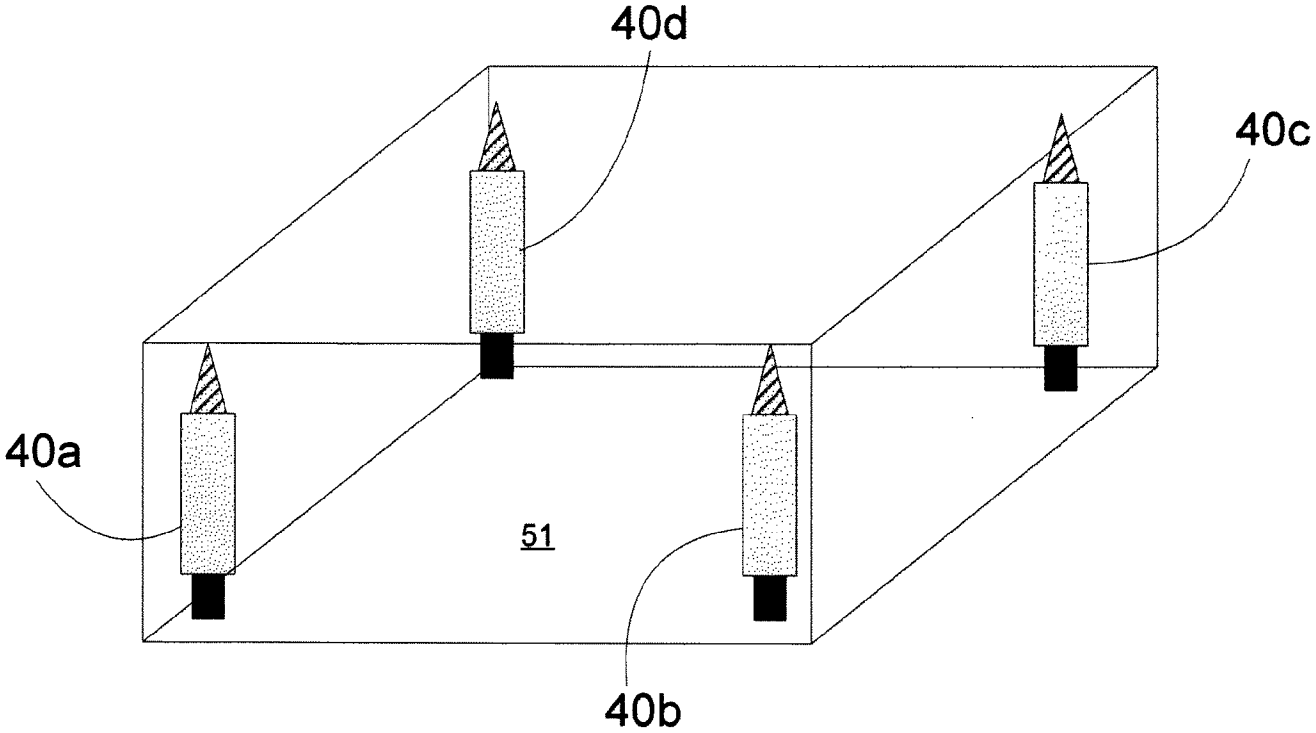
FIG. 6 is a diagram illustrating an example configuration of a magnetostrictive emitter in accordance with one embodiment of the technology described herein.

The high pass filters 20*a*, 20*b* can be configured to eliminate low frequencies that, after modulation, would result in deviation of carrier frequency (e.g., those portions of the modulated signal of FIG. 6 that are closest to the carrier frequency). Also, some low frequencies are difficult for the system to reproduce efficiently and as a result, much energy can be wasted trying to reproduce these frequencies. Therefore, high pass filters 20*a*, 20*b* can be configured to cut out these frequencies.

The low pass filters 18*a*, 18*b* can be configured to eliminate higher frequencies that, after modulation, could result in the creation of an audible beat signal with the carrier. By way of example, if a low pass filter cuts frequencies above 15 kHz, and the carrier frequency is approximately 44 kHz, the difference signal will not be lower than around 29 kHz, which is still outside of the audible range for humans. However, if frequencies as high as 25 kHz were allowed to pass the filter circuit, the difference signal generated could be in the range of 19 kHz, which is within the range of human hearing.

In the example system 10, after passing through the low pass and high pass filters, the audio signals are modulated by modulators 22*a*, 22*b*. Modulators 22*a*, 22*b*, mix or combine the audio signals with a carrier signal generated by oscillator 23. For example, in some embodiments a single oscillator (which in one embodiment is driven at a selected frequency of 40 kHz to 50 kHz, which range corresponds to readily available crystals that can be used in the oscillator) is used to drive both modulators 22*a*, 22*b*. By utilizing a single oscillator for multiple modulators, an identical carrier frequency is provided to multiple channels being output at 24*a*, 24*b* from the modulators. Using the same carrier frequency for each channel lessens the risk that any audible beat frequencies may occur.

High-pass filters 27*a*, 27*b* can also be included after the modulation stage. High-pass filters 27*a*, 27*b* can be used to pass the modulated ultrasonic carrier signal and ensure that no audio frequencies enter the amplifier via outputs 24*a*, 24*b*. Accordingly, in some embodiments, high-pass filters 27*a*, 27*b* can be configured to filter out signals below about 25 kHz.

Figure 3:
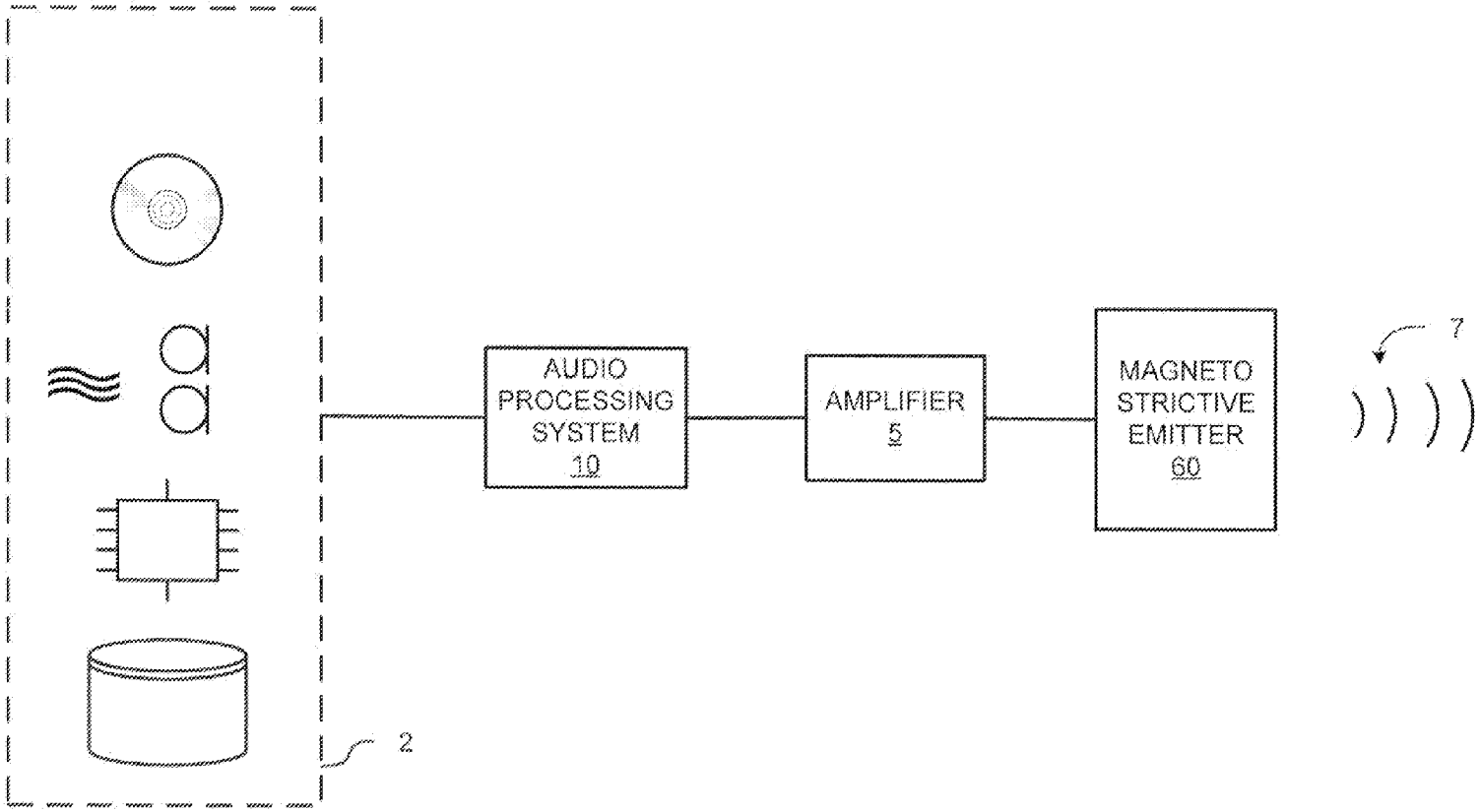
FIG. 3 is a block diagram illustrating an example of an ultrasonic sound system suitable for use with the emitter technology described herein.

In accordance with various embodiments, a magnetostrictive emitter, such as that described herein, can be used to launch an audio modulated ultrasonic signal. FIG. 3 is a block diagram illustrating yet another example ultrasonic sound system 8 in which a magnetostrictive emitter may be utilized. Particularly, the example of FIG. 3 Illustrates an example in which an audio processing system 10 is integrated into ultrasonic audio system 1 with a magnetostrictive emitter 30.

Accordingly, as seen with ultrasonic audio system 1 of FIG. 1, ultrasonic audio system 8 can be configured to receive audio content from one or more of a plurality of audio sources 2. Audio sources 2 may include, e.g., a microphone, memory, a data storage device, streaming media source, MP3, CD, DVD, set-top-box, or other audio source.

The audio content is processed by ultrasonic audio system 10, which may include, for example, the modules illustrated and described above with reference to FIG. 2. Ultrasonic audio system 10, after equalization and compression, the audio signal is modulated onto an ultrasonic carrier of a given frequency using a modulator 4 and a carrier signal generated by local oscillator 3. The carrier signal may be, for example, from 40 khz to 200 khz, or greater, although other carrier frequencies can be used. In some embodiments, a carrier signal in the range of 70 kHz to 100 kHz is used.

The audio-modulated ultrasonic signal may then be amplified using amplifier 5. After amplification, the audio-modulated ultrasonic signal is delivered to magnetostrictive emitter 30. The magnetostrictive emitter 30 includes one or more magnetostrictive actuators that convert the audio modulated ultrasonic signal (e.g., the electrical signal) into kinetic energy and induce vibrations in an emissive surface of the emitter 30.

The electrical signal representing audio content (e.g., music, voice, or other audio) modulated onto an ultrasonic carrier can be used to drive the magnetostrictive actuator. The electrical signal is provided to a coil in each actuator. The signal induces a magnetic field proximal to the coil, which causes a ferromagnetic core of the magnetostrictive actuator to change dimensions. Time varying changes in the magnetic field resulting time varying changes in the dimension of the core of the magnetostrictive actuator. These changes in dimension impart a time varying force on the emissive surface, causing the emissive surface to vibrate. This vibration of the emissive surface results in a change in pressure in the air surrounding the emissive surface launching the ultrasonic wave into the air (or other medium surrounding the emitter). The vibration of the emissive surface corresponds to variations in electrical signal. Accordingly, the ultrasonic wave emitted by the emitter corresponds to the audio-modulated ultrasonic signal. As noted above, this ultrasonic wave demodulates an error, reproducing the original audio content.

The core of the magnetostrictive actuator can be made using an alloy with strong magnetostrictive properties. The influence of the magnetic field on the core changes the dimensions of the core. Such changes can be quick enough to accurately represent a time varying ultrasonic signal. When the magnetic field is applied to the magnetostrictive actuator, the actuator converts the supplied electrical energy into kinetic energy. This kinetic energy supplied by the magnetostrictive actuator, can be used to induce vibrations in the emissive surface of the emitter. This vibration causes the surrounding air to vibrate and creates a pressure wave. When the electrical signal is an audio-modulated ultrasonic carrier, the vibration causes a corresponding audio modulated ultrasonic pressure wave to be emitted by the magnetostrictive emitter. In various embodiments, the magnetostrictive emitter can be more efficient and can be implemented to provide greater force than conventional emitters.

Figure 4:
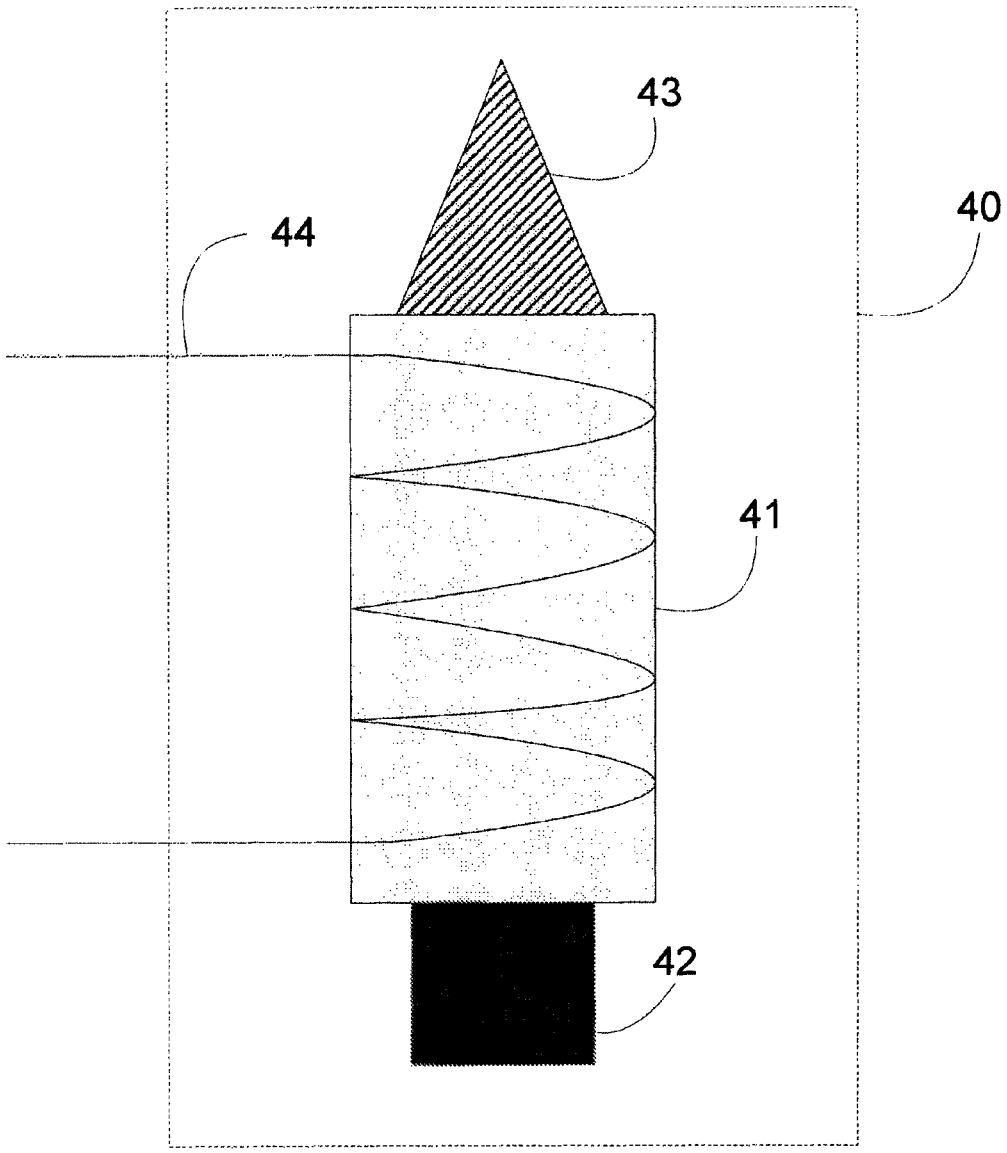
FIG. 4 is a diagram illustrating an example magnetostrictive actuator in accordance with one embodiment of the technology described herein.

FIG. 4 is a block diagram illustrating one example of a magnetostrictive actuator, in accordance with one embodiment of the technology disclosed herein. In the example of FIG. 4, an example of a magnetostrictive actuator 40 is illustrated. In this example, the magnetostrictive actuator 40 includes a core 41, a base 42, and a cap 43. Also included is a coil 44 through which current can be run. In operation, the application of current through coil 44 results in electromagnetic field that causes motion of cap 43 in a direction along the axis about which the coil 44 is wound (that is the up/down direction in the figure). When an audio-modulated ultrasonic signal is provided at coil 44, cap 43 moves in a manner corresponding to the audio-modulated ultrasonic signal.

In some embodiments, the motion of cap 43 is caused by changes in shape or dimensions of the core 41. Particularly, in some embodiments, core 41 may comprise a ferromagnetic material that is subject to magnetostriction—that is, it changes shape or dimension as a result of magnetization, which can be induced by the application of an electromagnetic field. The electromagnetic field can be generated by an electrical signal applied to coil 44, which may be wrapped around core 41. As noted above, the electrical signal applied to coil 44 may be the audio-modulated ultrasonic signal. Although any of a number of magnetostrictive materials may be used, in some embodiments, core 41 may be one of (or some combination of), for example, cobalt; terbium; iron; and dysprosium. Other materials that can be used can include, for example, Terfenol-D, and Metglas. It is noted that the length of core 41 may be dependent on, e.g., the wavelength of the ultrasonic carrier signal.

Figure 5:
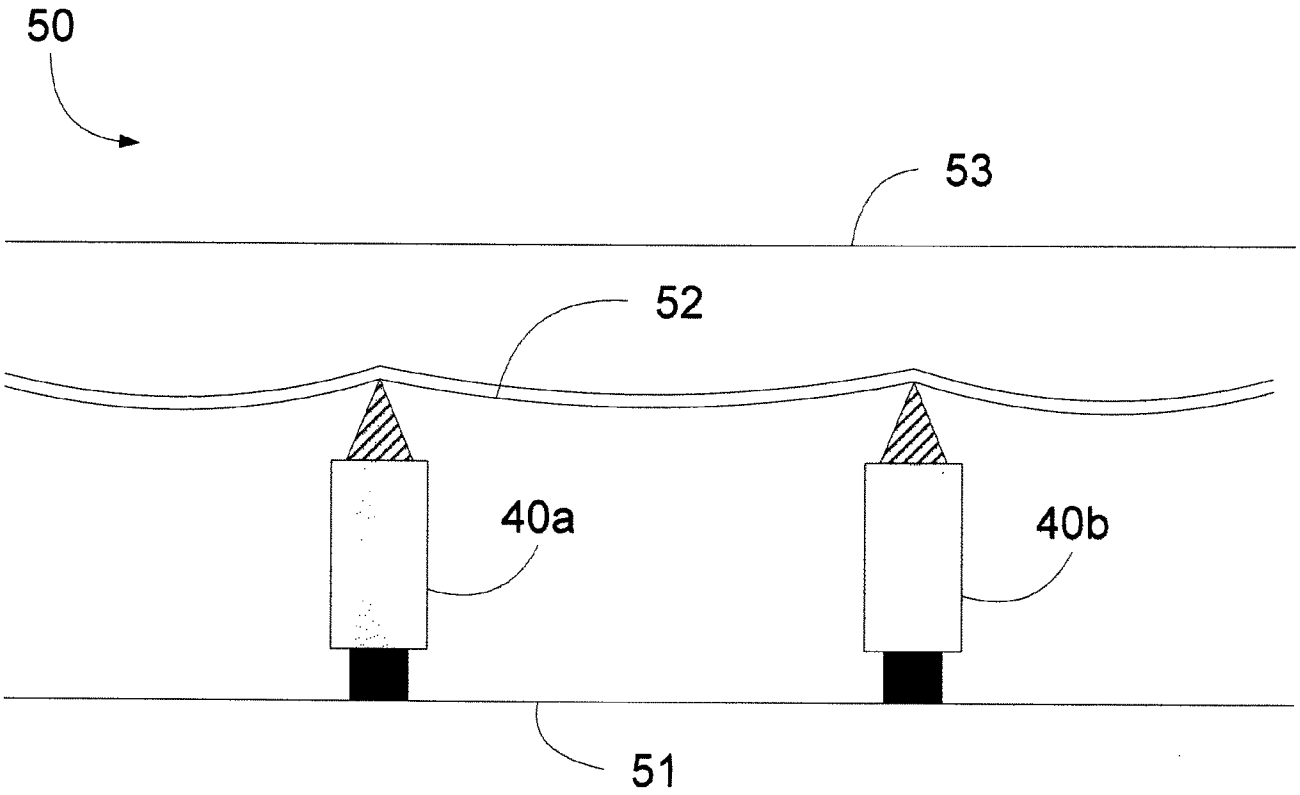
FIG. 5 is a diagram illustrating a magnetostrictive emitter in accordance with one embodiment of the technology described herein.

FIG. 5 is a diagram illustrating an example of a magnetostrictive emitter in accordance with one embodiment of the technology disclosed herein. This example includes a back plate 51, a emissive surface 52, and a plurality of magnetostrictive actuators 40. Although two magnetostrictive actuators are shown, after reading this description one of ordinary skill in the art will understand that other quantities of magnetostrictive actuators 40 may be provided. A faceplate 53 may also be provided.

As noted above with respect to FIG. 4, in operation, core 41 may extend or contract longitudinally in response to the applied electromagnetic field. This, in turn, causes the cap 43 to move. As can be seen by FIG. 5, movement of caps 43 (reference numerals and coils omitted from FIG. 5 for illustrational clarity) of actuators 40*a* and 40*b* will induce vibrations in emissive surface 52. That is, the kinetic energy generated by the magnetostrictive actuators causes the emissive surface 52 to vibrate. Where the actuators are driven by the audio modulated ultrasonic signal, the vibrations in emissive surface 52 closely correspond to the signal. These vibrations create vibrational mode residences in the emissive surface 52 causing a pressure wave to be launched into the air corresponding to the audio modulated ultrasonic signal.

Accordingly, in various embodiments, emissive surface 52 can be implemented using a flexible film that is susceptible to inducement of vibrations by movement of the magnetostrictive actuators such as, for example, Mylar, Kapton, or other like flexible films. Examples of such films are further described below. In some embodiments, the magnetostrictive actuators 40 can be configured to support emissive surface 52 at a distant separated from back plate 51 to allow freedom of vibration without dampening caused by contact between emissive surface 52 and back plate 51. Magnetostrictive actuators 40 can be configured as a sole means of support for emissive surface 52, or other support mechanisms can be used to support emissive surface 52 (e.g., support members around the perimeter of emissive surface 52).

In another embodiment, the magnetostrictive actuator(s) 40, 40 need not contact or support emissive surface 52. In such embodiments, air pressure generated by the movement of the rods can be sufficient to induce vibrations in emissive surface 52. For example, the actuators can be configured to operate in substantially the same manner in which an electromagnetic field induced by the audio modulated ultrasonic signal is generated by the coil, resulting in a dimensional change in the core. The kinetic energy generated by the movement of the core in response to the magnetic field may be sufficient to cause a change in pressure in the air or other medium surrounding the core thereby inducing a vibration in the emissive surface. As with the embodiments described above in which the actuators may contact the emissive surface, the vibrations induced in the emissive surface cause an audio modulated ultrasonic pressure wave to be launched into the air.

In further embodiments, the emissive surface can be made of a magnetic material, or a magnetic coating or layer can be applied to the emissive surface. In such embodiments, the emitter can be configured such that the magnetic pole of the emissive surface is the same pole as at the end of the core that is positioned closest to the emissive surface. As a result of configuring the system with like holes in proximity to one another, the emissive surface is repelled from the core as a result of their respective magnetic fields. Therefore, movements in the core (e.g., induced by the magnetic field generated by the audio-modulated ultrasonic signal) result in corresponding vibrations in the emissive surface material. In yet a further embodiment, the magnetic poles of the adjacent surfaces of the emissive surface and the core can be opposite poles, causing magnetic attraction. Accordingly, movement of the core in response the magnetic field may again induce vibrations in the emissive surface.

As noted above, the magnetic field in the coil or wire windings 44 is generated by the audio-modulated ultrasonic signal. Accordingly, in various embodiments, the coil or wire windings 44 are electrically coupled to receive the output of the amplifier of the ultrasonic audio system (e.g., amplifier 5). In accordance with various embodiments, the wire windings 44 may be configured in different ways depending on desired properties properties for the magnetostrictive emitter. For example, the wire windings 44 of the magnetostrictive actuator 40 may be wrapped closely together in order to generate a stronger electromagnetic field with less voltage. Alternatively, the wire windings 44 of the magnetostrictive actuator 40 may be wrapped farther apart.

In accordance with various embodiments, one or more magnetostrictive actuators 40 can be positioned within the magnetostrictive emitter 50 in order to cause different portions of the emissive surface 52 to vibrate with different signals. This could result in different zones to allow the magnetostrictive emitter 50 to be configured to function as multiple different emitters. In some embodiments, the vibrations in each zone can be set up so as not to interfere with one another. In further embodiments, the emissive surface 52 can be physically segmented to allow a complex emitter to be created with multiple magnetostrictive actuators 40. For example, the emissive surface can be mounted (e.g., using adhesives, glues or other mounting mechanisms) to a plurality of cross members thereby creating a plurality of vibrationally isolated zones across the area of the emissive surface.

Each zone can include one or more magnetostrictive actuators and each zone can be supplied with different ultrasonic signals. Accordingly, in effect, multiple emitters can be configured in an integrated package. This can be used, for example, to provide a multi-use emitter, or even a directionally controllable emitter in which delayed versions of the same signal are applied to the various actuators to form a phased-array magnetostrictive emitter.

Referring again to FIGS. 4 and 5, base 42 can be included to mount core 41 to back plate 51. In other embodiments, core 41 may be mounted directly to back plate 51. Base 42 may be included, for example, to provide a desired spacing between back plate 51 and emissive surface 52 with a given length core 41. Back plate 51 may include, in some embodiments, a rigid or semi-rigid material to provide structural support for the magnetostrictive emitter and to provide a sound mounting surface for the magnetostrictive actuators 40.

The cap 43 may be included and may be attached to the core 41 to support or contact the emissive surface 52 to induce vibrations therein. In the example illustrated in FIGS. 4 and 5, the cap is conical in shape. A conical shape can be used to minimize the contact area between the actuator 40 and emissive surface 52. This can minimize any dampening effect caused by contact between the emissive surface 52 and the actuator 40. Alternatively, other shapes or geometries can be used for cap 43 including cylindrical, conical sectional or other shape. This separation can be used to avoid contact of emissive surface 52 with the larger surface area of the top of core 41. Cap 43 may be made using any of a number of materials, but preferably the materials used are sufficiently rigid and of selected density to allow vibrations to be transmitted therethrough from the core to the emissive surface. In another embodiment, a plurality of small caps 43 may be arranged as an array on top of core 41 to provide a larger surface for generating ultrasonic frequency vibrations. In other embodiments, the orientation of the conical section on the core 41 is reversed to position a larger surface area at or near emissive surface 52.

As noted above, emissive surface 52 may be Mylar, Kapton, or other like material. In particular, in various embodiments the emissive surface 52 may comprise one or more tensioned films that generate ultrasonic signals that are emitted by the magnetostrictive emitter 50. As a further example, the one or more films of the emissive surface 52 may each comprise a flexible glass film, a Mylar film, a Polypropylene film, or a Polyvinylidene Fluoride (PVDF) film, polyethylene terephthalate (PET), biaxially-oriented polyethylene terephthalate (e.g., Mylar, Melinex or Hostaphan), Kapton, graphene, or other substrate, or other like films. As also noted above, emissive surface 52 can also be implemented with as a rigid or semi-rigid plate. Emissive surface 52 can be chosen and configured in the magnetostrictive emitter to have a particular resonant frequency or range of resonant frequencies. In such embodiments, the carrier frequency of the ultrasonic signals can be chosen to be at or sufficiently near the resonant frequency to take advantage of the resonant properties of the emitter. Factors that can affect the resonant frequency of the emissive surface can include, for example, the dimensions of the emissive surface, spacing of the emissive surface relative to the back plate, materials used to form the emissive surface, and the mounting of the emissive surface in the emitter.

The emissive surface 52 may also be configured in various shapes such as, for example, square, rectangular, circular, or ovate. The magnetostrictive emitter 50 can be made to any desired dimension. In one embodiment the magnetostrictive emitter 50 may be 10 inches long and 5 inches wide although other dimensions, both larger and smaller are possible. Practical ranges of length and width can be similar lengths and widths of conventional bookshelf speakers. Greater emitter area can lead to a greater sound output.

A protective screen 53 may be included and may comprise a suitable material that may protect the magnetostrictive emitter 50 and in particular, the emissive surface 52 from damage. The material that is utilized for the protective screen 53 may be selected so that it may enhance the ultrasonic output. In an embodiment of the disclosure, the protective screen 53 may comprise a plastic screen. The plastic screen may function as an impedance matching network that increases the ultrasonic output. The protective screen 53 may be cosmetic and may also enable the emitter to get standard approval such as Underwriters Laboratory (UL) approval. In some embodiments, protective screen 53 can have a plurality of openings such as a grating or grill that can allow the ultrasonic waves to pass through the screen, while providing protection to the emissive surface 52.

FIG. 6 is a diagram illustrating an example in which a plurality of magnetostrictive actuators are provided in an ultrasonic emitter. In this example, four magnetostrictive actuators 40 are provided and placed at or near the four corners of the magnetostrictive emitter, although other quantities can be used. Proper placement of the magnetostrictive actuators 40 may effectuate different areas of resonance with minimal destructive overlap in order for a single emissive surface 52 to act as one emitter, allowing the device and take full advantage of the surface area of emissive surface 52. For example, multiple actuators can be placed at distances from one another that are wavelength multiples of the carrier frequency. This can allow for constructive interference between the vibrations induced by each actuator, which may increase the output of the magnetostrictive emitter.

In other embodiments, different placement of the one or more magnetostrictive actuators 40 may allow different areas of resonance to be set up in the emissive surface so that a single emissive surface 52 can be configured to act as different emitters. As noted above, in some embodiments, the different emitter sections can be mounted such that the borders around the sections are vibrationally dampened to avoid interference from one section impacting adjacent sections.

This can be useful, for example, to configure the emitter as effectively including a tweeter, subwoofer, and mid-range driver with a single emissive surface. This can allow a two- or three way emitter to be implemented with a smaller footprint and fewer components as compared to a conventional loudspeaker. For example, the high frequencies, midrange, and low frequencies of the audio signal can be separated, modulated onto separate ultrasonic carriers, and sent to separate magnetostrictive actuators, or separate groups of actuators. Each actuator group of actuators corresponding to one of these frequency ranges can be used to induce corresponding vibrations in the emissive surface to create a three-way emitter.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A magnetostrictive ultrasonic audio emitter, comprising:
an emissive surface comprising a film;
a back plate;
a plurality of magnetostrictive actuators mounted on the back plate and positioned between the emissive surface and the back plate, wherein each of the plurality of magnetostrictive actuators is:
in touching relation to and supports the emissive surface; and
configured to receive an audio modulated ultrasonic signal, and to induce vibrations in the emissive surface in response to the audio modulated ultrasonic signal; and
a protective screen for protecting the emissive surface,
wherein the film is tensioned across the back plate such that it vibrates and launches an audio modulated ultrasonic beam into the air in response to pressured applied by the plurality of magnetostrictive actuators on the film.

2. The magnetostrictive ultrasonic audio emitter of claim 1, wherein the ultrasonic audio emitter has a resonant frequency that is the same as or substantially the same as a carrier signal of the audio modulated ultrasonic signal.

3. The magnetostrictive ultrasonic audio emitter of claim 1, wherein each of the plurality of magnetostrictive actuators comprises a core and a coil wound about the core.

4. The magnetostrictive ultrasonic audio emitter of claim 3, wherein the core is configured to change dimensions in response to a magnetic field generated by a time-varying electrical signal in the coil.

5. The magnetostrictive ultrasonic audio emitter of claim 4, wherein the time varying electrical signal is an audio modulated ultrasonic signal.

6. The magnetostrictive ultrasonic audio emitter of claim 1, wherein each of the plurality of magnetostrictive actuators changes its geometry in response to the application of an audio modulated ultrasonic signal, and further wherein these changes in geometry of the magnetostrictive actuator cause vibrations in the emissive surface.

7. The magnetostrictive ultrasonic audio emitter of claim 6, wherein the emissive surface comprises a magnetic material, further wherein the magnetic pole of the magnetostrictive actuator facing the emissive surface is the same polarity as the magnetic pole of the emissive surface facing the magnetostrictive actuator.

8. The magnetostrictive ultrasonic audio emitter of claim 1, wherein portions of the emissive surface are dampened.

9. The magnetostrictive ultrasonic audio emitter of claim 1, wherein each of the plurality of magnetostrictive actuators comprises a core, a coil, and a cap.

10. The magnetostrictive ultrasonic audio emitter of claim 1, wherein the emissive surface comprises a magnetic material.

11. The magnetostrictive ultrasonic audio emitter of claim 1, wherein the plurality of magnetostrictive actuators comprises four magnetostrictive actuators, wherein each of the four actuators is placed in a respective corner of the magnetostrictive ultrasonic audio emitter.

12. The magnetostrictive ultrasonic audio emitter of claim 1, wherein the film comprises at least one of Mylar, Kapton, PET, PVDF, Melinex and Hostaphan.

13. The magnetostrictive ultrasonic audio emitter of claim 1, wherein the emissive surface comprises a rigid or semi-rigid plate.

* * * * *